US010484765B2

(12) United States Patent
Husnik et al.

(10) Patent No.: US 10,484,765 B2
(45) Date of Patent: Nov. 19, 2019

(54) DIGITAL LOUDSPEAKER

(71) Applicants: UNIVERSITE DU MAINE, Le Mans (FR); CENTRE NATIONAL DE LA RECHERCHE SCIENTIFIQUE, Paris (FR); CZECH TECHNICAL UNIVERSITY IN PRAGUE, Prague (CZ)

(72) Inventors: Libor Husnik, Prague (CZ); Philippe Bequin, Challes (FR); Pierrick Lotton, Pruille-le-Chetif (FR)

(73) Assignees: UNIVERSITE DU MAINE, Le Mans (FR); CENTRE NATIONAL DE LA RECHERCHE SCIENTIFIQUE, Paris (FR); CZECH TECHNICAL UNIVERSITY IN PRAGUE, Prague (CZ)

( * ) Notice: Subject to any disclaimer, the term of this patent is extended or adjusted under 35 U.S.C. 154(b) by 0 days.

(21) Appl. No.: 15/578,056

(22) PCT Filed: Jun. 1, 2016

(86) PCT No.: PCT/EP2016/062423
§ 371 (c)(1),
(2) Date: Nov. 29, 2017

(87) PCT Pub. No.: WO2016/193327
PCT Pub. Date: Dec. 8, 2016

(65) Prior Publication Data

US 2018/0160203 A1 Jun. 7, 2018

(30) Foreign Application Priority Data

Jun. 1, 2015 (EP) ..... 15305842

(51) Int. Cl.
*H04R 1/00* (2006.01)
*H04R 3/12* (2006.01)

(52) U.S. Cl.
CPC ..... *H04R 1/005* (2013.01); *H04R 3/12* (2013.01); *H04R 2203/12* (2013.01); *H04R 2217/03* (2013.01)

(58) Field of Classification Search
CPC ..... H04R 1/005; H04R 3/12; H04R 2203/12; H04R 2217/03
See application file for complete search history.

(56) References Cited

U.S. PATENT DOCUMENTS 3,476,887 A 11/1969 Seligson et al.
4,194,095 A 3/1980 Doi et al.
(Continued)

FOREIGN PATENT DOCUMENTS

CN 103167380 A * 6/2013
EP 1 063 866 A1 12/2000
(Continued)

OTHER PUBLICATIONS

Englander, 14.2 The Fundamentals of Signal Processing from the Architecture of Computere Hardware, Systems, Software and Technology Approach, 5th Edition, John, Wiley & Sons, 2014.*
(Continued)

*Primary Examiner* — Sonia L Gay
(74) *Attorney, Agent, or Firm* — Westerman, Hattori, Daniels & Adrian, LLP

(57) ABSTRACT

A method for reproducing an acoustic signal from a digital signal, the digital signal being formed of successive bit sequences each having bits representative of the amplitude of an acoustic signal at a time sample, the method including (i) providing a plurality of transducers configured to emit acoustic signals that are wave trains having each a duration
(Continued)

Figures 1A, 1B, 1C:
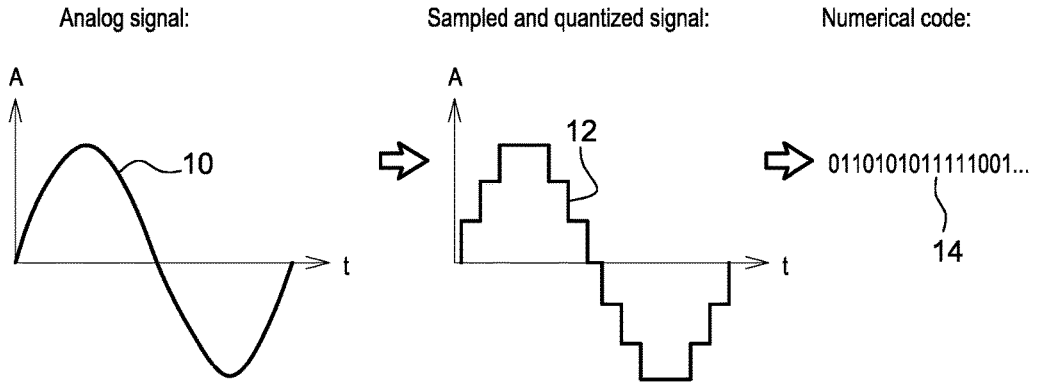

lower or equal to the duration of one time sample and including at least one oscillation per time sample, and (ii) successively, for each bit sequence, having each bit associated to at least one of the transducers and independently govern, depending on its value, amplitudes of the acoustic signals emitted by its associated transducers.

20 Claims, 3 Drawing Sheets

(56) References Cited

U.S. PATENT DOCUMENTS

| | | | | |
|---|---|---|---|---|
| 4,515,997 | A | 5/1985 | Stinger, Jr. | |
| 5,850,060 | A * | 12/1998 | Gerber | G10K 11/28 181/175 |
| 6,556,687 | B1 * | 4/2003 | Manabe | H04R 1/403 381/387 |
| 2005/0005143 | A1 * | 1/2005 | Lang | G11B 20/00086 713/193 |
| 2007/0030977 | A1 * | 2/2007 | Konagai | H04R 3/12 381/17 |
| 2013/0121509 | A1 * | 5/2013 | Hsu | H04R 19/005 381/104 |
| 2014/0294226 | A1 * | 10/2014 | Suvanto | H04R 1/04 381/398 |

FOREIGN PATENT DOCUMENTS

| | | | | |
|---|---|---|---|---|
| FR | 2790353 | A1 * | 9/2000 | H04R 1/005 |
| JP | 54-97013 | A | 7/1979 | |
| JP | 57-185789 | A | 11/1982 | |
| JP | 57-185794 | A | 11/1982 | |
| JP | 2006-197539 | A | 7/2006 | |

OTHER PUBLICATIONS

International Search Report and Written Opinion dated Sep. 15, 2016 issued in corresponding application No. PCT/EP2016/062423; in English (10 pages).

European Search Report and Written Opinion dated Nov. 18, 2015 issued in corresponding application No. EP15305842; in English (5 pages).

* cited by examiner

DIGITAL LOUDSPEAKER

The present invention concerns a method and a device for producing an acoustic signal from a digitally encoded electromagnetic signal. More particularly, the invention is related to the category of loudspeaker which directly converts a digital signal into an acoustic signal, without having first to convert the digital signal into a conventional analogue electrical signal used to drive the loudspeaker.

It is known in the prior art to convert audio signals, such as voice or musical signals, into a pulse code modulation (PCM) digital signal which is then recorded for later reproduction or transmitted to a distant point for reproduction over a telephone line, for example. This enables audio signals to be recorded or transmitted and then reproduced, without any information loss. Specifically, the analog voice signal is sampled at a constant rate, commonly 44 kHz, and a digital word is produced and transmitted at each sampling, one bit of the digital word representing the polarity and at least one bit of the digital word representing the magnitude of the analog voice signal at the time of sampling. The digital word usually comprises a total of 16 or 24 bits. The digital word is converted back to an analog signal which is then applied to a conventional speaker.

Consequently, for sound reproduction according to the prior art, it is necessary to convert the PCM signal into an analogue electrical signal. That is to say, before electro-acoustic conversion, a Digital-to-Analog Converter (commonly abbreviated as a DAC) that can accept PCM signals must be provided to convert the PCM signal into an analog electrical signal that the speaker will accept. The use of such a converter not only increases the cost and bulk of the reproduction system, but requires feeding of supplementary energy to operate the conversion process, and introduces signal distortion produced by conversion and amplification. Moreover, the system is still subject to distortion and coloration of sound produced by analog loudspeakers as well as their inefficiency.

It has been proposed in the prior art, for example in patent publication U.S. Pat. No. 4,515,997 A and EP 1063866 B1, to provide digitally controlled loudspeakers which decode a digitally-encoded signal received serially by code word to drive a plurality of substantially identical low inertia sound pressure generating elements or transducers, each of which elements or transducers has a drive individually associated therewith for producing the discrete sound levels encoded in the digitally-encoded signal, a PCM signal, for example, that is received serially by code word, with the drivers arranged in an array or "soundel" that is capable of producing the full range of the encoded sound. Soundels may be connected in parallel and built up into larger speaker panels that may be planar, or formed with concave or convex surfaces, and of a size appropriate for overall sound levels and power handling. The individual drivers may be pulsed at the encoding carrier frequency rate, commonly, 44 kHz, as mentioned above. The total number of drivers on, or powered, during any given pulse would correspond directly to the encoding of the digital word for that pulse. For example, if bit 1 of the commonly used 16 bit word is on, only one driver will be powered during the pulse for that word; if bit 5 is on, 16 drivers will be powered.

However, in such loudspeaker, the individual transducers are spatially separated such that the listener can be at a different distance from each transducer. In such case, while the individual acoustic pressures are generated at the same time by the transducers, the listener receives them timely shifted and interfering, even destructively, and the appropriate amplitude cannot be returned to the listener for each pulse, and the signal quality can rapidly decrease depending on the position.

An ionic electro-acoustic transducer employed as a loudspeaker is disclosed in U.S. Pat. No. 3,476,887 that was issued on Nov. 4, 1969 to A. L. Seligson et al. All detailed discussion of this transducer in the specification of the patent is concerned with the transducer as an analog device.

A direct digital loudspeaker with digital-to-analog conversion occurring after electro-acoustic transduction is disclosed in U.S. Pat. No. 4,194,095. This loudspeaker depends for its operation upon the switching, that is, the turning off and on, at an ultrasonic rate, of several digital bit related (air) outlet valves. The air outlets comprise horns that are sized to relate to the significance of the digital bits in the coded signals which control them. The air supply includes a pump and a reservoir.

The loudspeaker of U.S. Pat. No. 4,194,095 involves a large number of mechanical parts such as the air pump and the reservoir, output horns, precision valving and piloting mechanism, and multiple air ducts. The valve driving electronics involves several stages of wave shaping to drive the device from a normal serially coded signal in addition to a serial-to-parallel "buffer." Also, the acoustic output is one-sided, providing positive pressure toward the listener, rather than a preferred push-pull mode of operation. Further, the actual overall fidelity of the sound produced by this speaker system would be reduced by the extraneous noise made by the pumping and duct systems.

The invention has the purpose of proposing a digital loudspeaker which does not reproduce the prior art deficiencies.

Thus, it is proposed a method for reproducing an acoustic signal from a digital signal, said digital signal being formed of successive bit sequences each comprising bits representative of the amplitude of an acoustic signal at a time sample, the method comprising the steps of:

providing a plurality of transducers configured to emit acoustic signals that are wave trains having each a duration lower or equal to the duration of one time sample and comprising at least one oscillation per time sample, successively, for each bit sequence, having each bit associated to at least one of the transducers and independently governs, depending on its value, amplitudes of the acoustic signal i.e. wave trains emitted by its associated transducers, in a manner to obtain a carrier wave that is modulated in amplitude according to the digital signal.

According to the invention, for successive bit sequences, the amplitude of the operating transducers and/or the number of transducers concretely operating vary in time, so that at a point where the signals of the transducers are all superposed, preferably a focalization point where all the signals are configured to be in phase, the superposition of all the signals generate a new single signal whose shape and amplitude vary according to the information given by the bit sequences, i.e. according to the variation in time of the sum of the amplitudes of the single emitted acoustic signals. It here occurs a physical phenomenon well known in the art and called self demodulation, thanks to which the superposition of high frequency signals, modulated in amplitude thanks to the processing of the method of the invention, generates a lower frequency signal sensibly corresponding in shape to the amplitude variation of the high frequencies. Such phenomenon is generally used in acoustic parametric arrays which are well known in the art.

In the prior art, the acoustic signal is reconstituted by linearly adding single sound pulse pressures from a varying number in time of transducers, and the individual sound pulse pressures which correspond to a same time sample have to be synchronously superposed at the listening point, i.e. in phase, to obtain a sufficiently good restitution of the information. This limits the spatial positions where the signal can be accurately listened. On the contrary, the invention as defined above allows obtaining a digital loudspeaker which restitutes the acoustic information defined by the digital signal with good accuracy and faithfully, in any point of the space where the acoustic signals of the transducers propagate together.

As it is usually desired to reproduce an audible final signal, the individual signal of each transducer should not be audible because it would perturb the listening information. It is thus more advantageous to use transducers that emit ultrasonic signals, for example at a fundamental frequency equal to or above 20 kHz, and to obtain an audible self demodulated final signal.

Moreover, the sampling frequency of the signal to reproduce is generally of 44 kHz. In such case, the transducers should emit individual signals at a frequency equal to or above 44 kHz.

In a proposed embodiment, the fundamental frequency of the acoustic signal emitted by the transducers is at least twice greater than any frequency of sampling of the acoustic signal to be reproduced. The shape of the acoustic signal emitted by the ultrasonic transducers can be of any waveform, and can be sinusoidal. In one preferred embodiment, the acoustic signal is a periodic and alternating signal. In a more preferred embodiment of the invention, the wave train emitted by the transducers is of sinusoidal shape, i.e. containing one single frequency, and may have a duration equal to the time sample of the bit sequence. Advantageously, the wave train is of the type that can be defined as follows:

$$s(t)=A\cos 2\pi f_0 t\cdot\Pi_{T_C}(t-T_C/2)$$

Where $\Pi_{T_C}(t-T_C/2)$ is the gate function having a width of $T_C$, $T_C$ is the duration of a time sample, $f_0$ is the frequency of the sinusoidal signal within the wave train, A is the maximum amplitude.

At a time sample, all the transducers are configured to emit, if required to do so, a same wave train. Also, the same wave train can be used for all time samples. The wave train can comprise several oscillations and for example five or six oscillations.

A bit sequence as defined in the invention is a group of a given number of bits. Each bit is a basic unit of information, which can only take two different values: "0" or "1". Depending on the values of the bits, each bit sequence can transcribe a different amplitude of the acoustic signal at a time sample.

In order to appropriately decode the digital signal, information is also provided concerning the length, in bits, of each bit sequence, and the time sample attributed to each bit sequence. Such information can be input in advance in a decoding unit that uses the digital signal to drive the transducers, or can be coded in the digital signal along with the bit sequences. It is common to have all the bit sequences contain the same number of bits, commonly 16 or 24 bits, and following each other in the digital signal in the same order than the chronology of the associated time samples. Such time samples are usually issued at a regular frequency from the acoustic signal to be reproduced, commonly more than 44 kHz, even if it is possible to proceed otherwise.

It is preferable, for a faithful reproduction of the signal, that the bit sequences are used to operate the transducers in a temporal succession corresponding to the chronology, i.e. the time distribution, of their associated time samples, and that the emission of the transducers for each bit sequence remains active until the use of the next bit sequence.

In a particular embodiment, each bit sequence comprises quantification bits which indicate a quantified absolute value of the amplitude of the acoustic signal to be reproduced at the time sample associated with the bit sequence, with or without one polarity bit which indicate the polarity of the acoustic signal to be reproduced at the time sample associated with the bit sequence.

In a preferred embodiment, successively for each bit sequence, one of the value of each quantification bit does not induce any variation of the amplitudes of the acoustic signals emitted by its associated transducers, and the other one of the value of each quantification bit induces a variation of the amplitudes of the acoustic signals emitted by its associated transducers. All the variations of amplitudes induced by each quantification bit are of the same sign.

In a particular embodiment, the polarity bit can be used to determine a positivity or negativity of all the variations of amplitudes of same sign induced by the quantification bits.

In another embodiment, a polarity bit is not necessary, as the quantifications bits are always used to induce variations of amplitude of a same sign.

Preferably, the quantifications bits of a bit sequence define a binary number. A binary number is a number expressed in the binary numeral system, or base-2 numeral system. As a consequence, for example, the binary number "1000" equals twice the binary number "100". In a binary number, a bit value of "1" at a rank n implies that the amplitude has been raised by $2^{n-1}$ relatively to the amplitude which corresponds to the unit of the binary number. The unit is considered to be at the rank n=1.

Consequently, when using quantification bits as a binary number, a bit of value "0" will not induce any variation of the amplitudes of the acoustic signals emitted by its associated transducers, and a bit of value "1" will induce a variation of the amplitudes of the acoustic signals emitted by its associated transducers.

Also, according to the above properties of a binary number, it is advantageous that for each bit sequence, the bits of a higher rank of the binary number induce either a greater variation in amplitude or a variation in amplitude of more associated transducers than the bits of lower rank of the binary number.

The total variation of amplitude of the signals emitted by the transducers, induced by a bit at a rank n of the binary number formed by the quantification bits, are preferably sensibly twice larger than the total variation of amplitude induced by a bit at a rank n−1.

In order to do so, a bit at a rank n can be associated to twice the number of transducers than the bit at a rank n−1, while the variations of amplitudes of the signals emitted are sensibly the same for each transducer.

It is also possible to have each bit of the quantifications bits associated to the same number of transducers, while the variations of amplitudes of the signals emitted by the transducers associated to a bit of rank n are sensibly twice larger than the variations of amplitudes of the signals emitted by the transducers associated to the bit of rank n−1.

It is also possible to have a combination of both rising the numbers of emitting transducers and the variations of amplitudes of the signals emitted by the transducers for a bit of higher rank.

It is reminded that, since the transducers emit alternative acoustic signals, when a variation of amplitude of the signal emitted by the transducers induces a transducer to operate at a negative amplitude, it is equivalent to say that the signal is phase-shifted by $\pi$, i.e. of opposite phase, while keeping a positive amplitude of same absolute value.

The transducers whose operations are not modified by any quantification bit are preferably at an off default state. Such embodiment has the advantage of not inducing a high consumption of energy, as all the transducers which are not necessary to the reproduction of the acoustic signal do not consume energy.

In such situation, a negative variation of amplitude of the signal can thus be equivalent to a positive variation of amplitude of same absolute value with a signal phase-shifted by $\pi$, i.e. of opposite phase. Though, in such situation, the differences of reproduction of the signal, when operating a positive variation compared to a negative variation of amplitude of the signal, are not significant, such that it is possible to always operate the variations of amplitudes with the same sign, regardless of the value of the polarity bit.

In another embodiment, the transducers whose operations are not modified by any quantification bit may emit a signal at a constant nonzero amplitude, preferably the same for all the transducers. In such case, it is possible to maintain each transducer operate at an amplitude of nonzero absolute value whatsoever the variations of amplitude induced by the quantification bits and the polarity bit, by setting the default amplitude at a sufficiently high absolute value, i.e. higher than the maximum amplitude variation the can be induced by a bit sequence of the digital signal.

In a particular embodiment, each transducer has the amplitude of its acoustic signal determined by at most one bit value of each bit sequence. Moreover, a transducer can be associated always to the bits of same rank of the bit sequences, when binary numbers are defined.

In one possible embodiment, each transducer has got only two different operating states, one of which is the default state. In such configuration, the values of the quantification bits are used to activate or not the driving of the transducers.

In another possible embodiment, each transducer has got only three operating state, one of which is the default state. The two other states can be states wherein the differences of amplitudes relatively to the default state are opposite.

Besides, the different states of all the transducers are preferably the same.

The digital signal is usually an electric signal, and the transducers are usually electro-acoustic transducers driven by an alternative current or an alternative voltage governed by the bits of the bit sequences.

In order to have the bits govern the transducers, a computer, micro-controller or DSP (Digital Signal Processor) system can be used and linked to amplifiers and modulators which generate electric signals for driving the transducers.

By processing each bit independently, and successively for each bits sequence, the computers regulates the amplifiers and modulators in order to drive the transducers as desired.

As described above, it is advantageous to have all the transducers arranged so that the acoustic signals emitted by the transducers are able to converge to a same focus in phase. It is an object of the invention to provide a particular arrangement of the transducers to do so. At the focus, the self-demodulation is then optimized and the generated signal of lower frequency, which corresponds to the amplitude variations of the signals of higher frequency emitted by the transducers, is of a better quality compared to the signal digitally encoded.

A first arrangement allowing obtaining such focus is for example while the transducers are all arranged facing orthogonally on the internal surface of a portion of a sphere. The center of the sphere is then the focus.

A second arrangement is for example while the transducers are all arranged facing orthogonally on a plane surface itself orthogonal to the axis of a parabolic surface. The focus of the parabola is then the focus described above.

If all the signals emitted by the transducers are not exactly in phase at the focus, it remains possible to phase-shift the different emitted signals of the transducers until they are in phase at the focus.

So as to optimize self-demodulation, particular amplitudes and shapes of the acoustic signals emitted by the transducers can be chosen, as in an acoustic parametric array. The amplitude should be as high as possible, provided that the transducers are being operated in their linear range. Also, the distance between the speakers and the focal point should correspond to a distance for which a demodulation has been performed.

In a preferred embodiment, means of redirection of the signal are arranged at the focus, so as to transform the focus into a source point for the self-demodulated signal. Devices like a waveguide, a diffraction slot, an acoustic lens, can be used for this purpose.

Thanks to such arrangement, the self-demodulated signal generated at the focus can spread in many directions from the means of redirections, compared to the very unidirectional signal generally emitted by the transducers. The self-demodulated signal can then be received faithfully in many points of the space.

The invention also concerns a loudspeaker adapted to reproduce the above method, in its most basic definition or along with all the described complementary elements.

More particularly, the invention concerns a loudspeaker comprising a plurality of transducers configured to emit acoustic signals at a predetermined frequency which is equal or greater than any frequency of sampling of the acoustic signal, and arranged so that said acoustic signals converge at a same focus in phase, the loudspeaker being further configured so that a digital signal, being formed of successive bit sequences each comprising bits representative of the amplitude of an acoustic signal at a time sample, can be used in such a way that successively, for each bit sequence, each bit is associated to at least one of the transducers and independently governs, depending on its value, the amplitudes of the acoustic signals emitted by its associated transducers.

It is also proposed a method for reproducing an acoustic signal from a digital signal, said digital signal being formed of successive bit sequences each comprising bits representative of the amplitude of an acoustic signal at a time sample, the method comprising the steps of:

- providing a plurality of transducers configured to emit acoustic signals, i.e. acoustic wave at a predetermined frequency which is equal or greater than any frequency of sampling of the acoustic signal;
- successively, for each bit sequence, having each bit associated to at least one of the transducers and independently governs, depending on its value, the amplitudes of the acoustic signals emitted by its associated transducers, in a manner to obtain a carrier wave having the frequency of the acoustic signal emitted by the transducers and that is modulated in amplitude according to the digital signal.

For each bit sequence, successively, the invention uses one or more transducers that each emits the same signal of frequency which is equal or greater than any frequency of sampling of the acoustic signal, preferably during the whole duration attributed to the time sample of the bit sequence.

Figure 2:
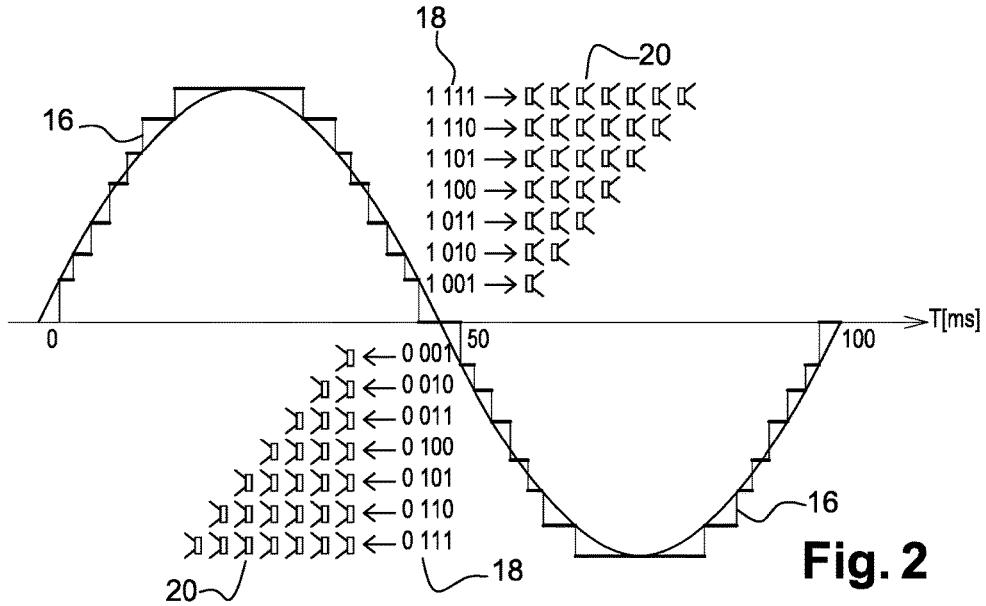
Figure 3:
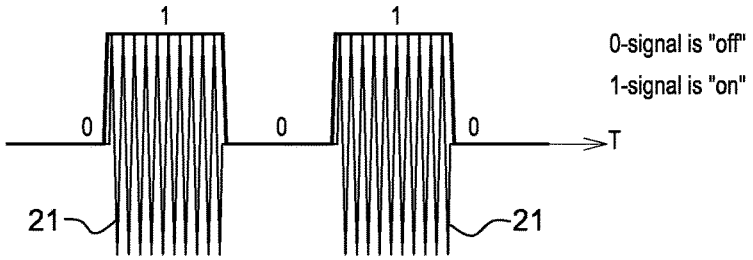
Figure 4:
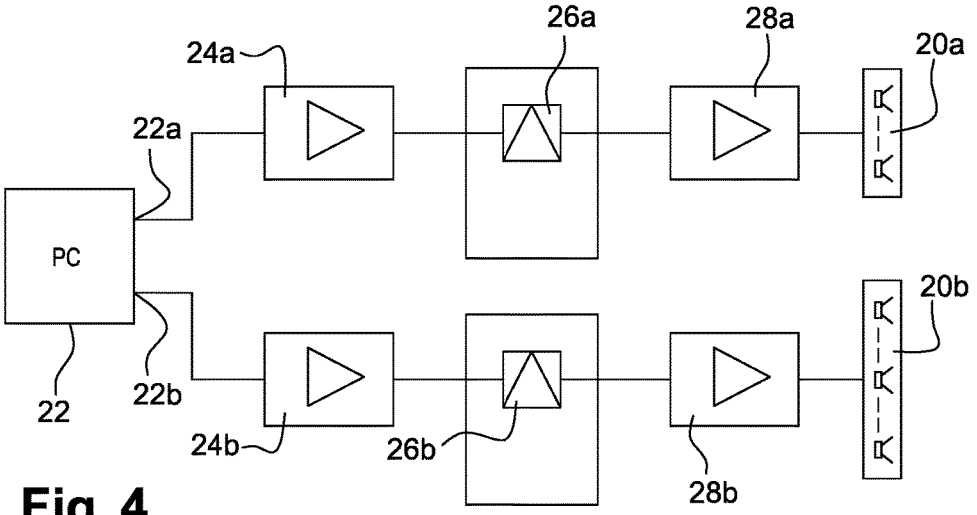
Figure 5:
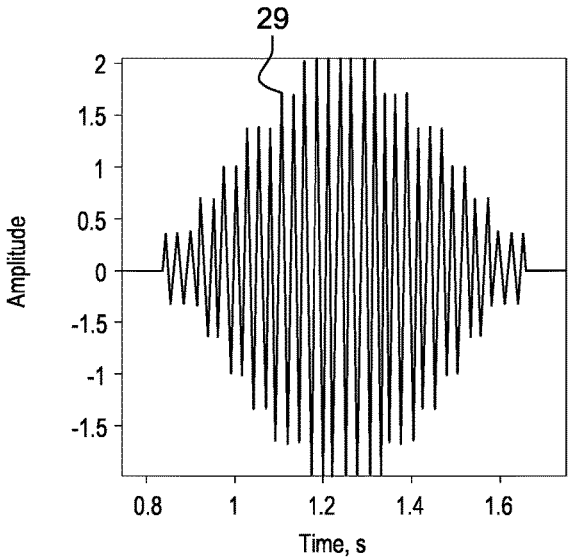
Figure 6:
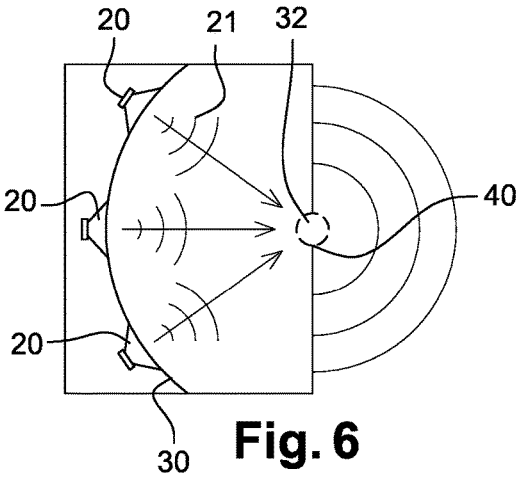
Figure 7:
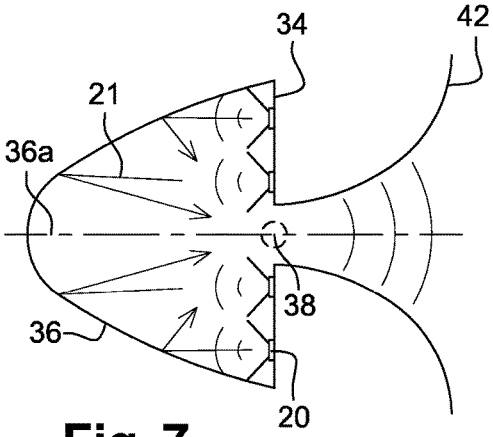
Figure 8A:
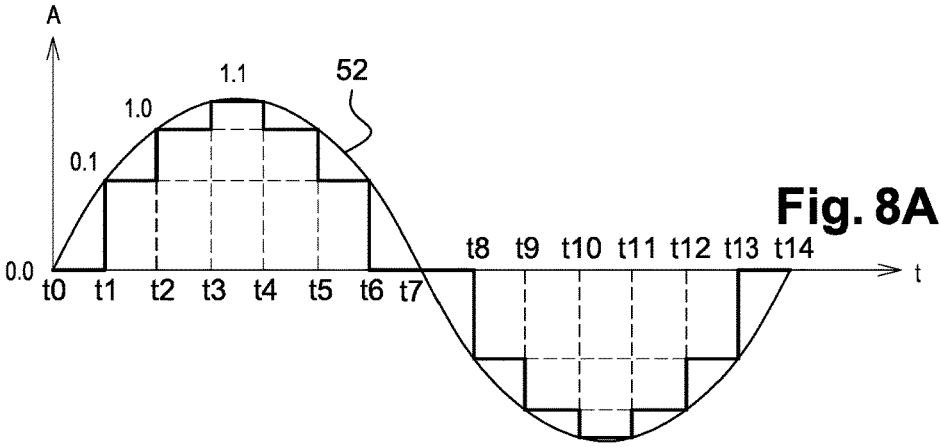
Figure 8B:
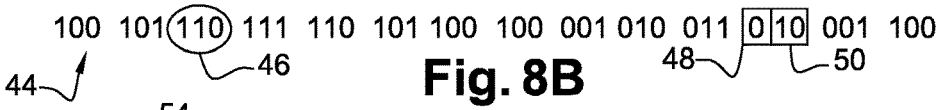
Figure 9:
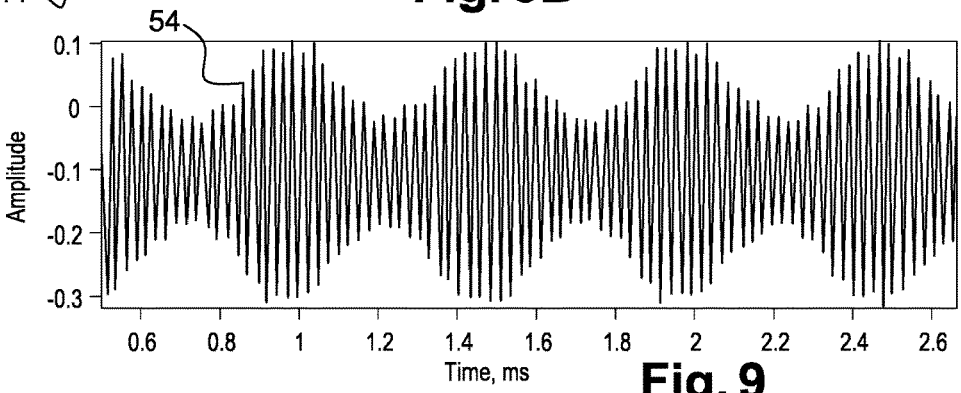
Figure 10:
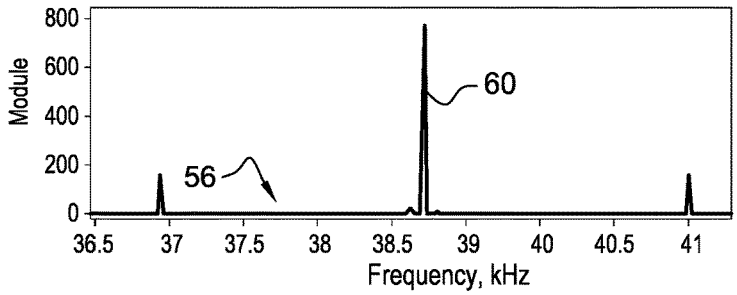
Figure 11:
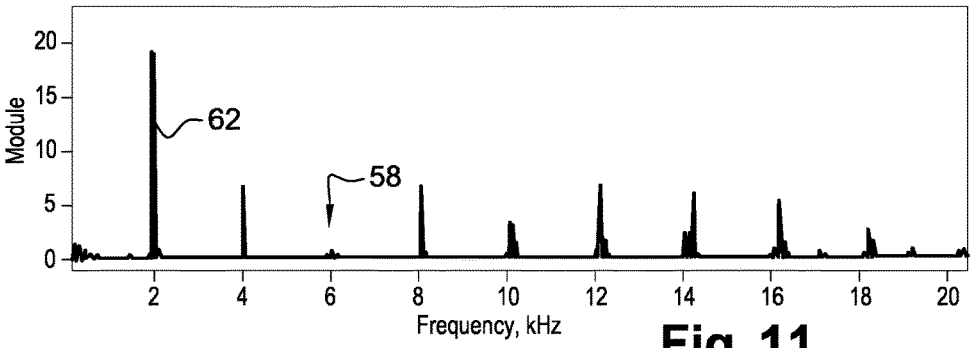

The invention can be better understood and other details, characteristics, and advantages of the present invention appear more clearly on reading the following description made by way of non-limiting example and with reference to the accompanying drawings, in which:

FIGS. 1A, 1B and 1C are diagrams showing the transformation of an analogic signal into a digital signal, FIG. 2 is a diagram showing how transducers are associated to bits of a digital signal, FIG. 3 is a diagram showing an operation of a transducer during a little duration according to the value of its associated bits in the digital signal, FIG. 4 is a diagram showing a system used to drive the transducers, FIG. 5 shows an example of a sum of signals emitted by different transducers during a little duration, FIG. 6 is a diagrammatic example of arrangement of the transducers, coupled with acoustic propagation means, FIG. 7 is another diagrammatic example of arrangement of the transducers, coupled with acoustic propagation means, FIGS. 8A and 8B schematically illustrate source analogic signal quantified and sampled to a digital signal, then used as an entry signal in the method of the invention, FIG. 9 show the acoustic signal measured at the focus of the invention, when processing the digital signal of FIG. 8, and FIGS. 10 and 11 are Fast Fourier Transformations of the acoustic signal illustrated in FIG. 9.

FIGS. 1A, 1B and 1C illustrates the transformation of an audible analogic signal into a digital signal. The source analogic signal 10 is here a sinusoidal wave. The analogic signal 10 is sampled in time at a chosen frequency. For each time sample, it is calculated an average of the amplitude of the analogic signal, which is chosen to transcribe the value of the amplitude at the associated time sample. As a consequence, from the continuous information given by the analogic signal, only discrete values of amplitude, exactly one by time sample, are conserved, as illustrated on the transformed wave 12 of FIG. 1B. Then, a finite number of bits are chosen. Those bits constitute together a bit sequence which is used to represent the value of the average amplitude corresponding to a time sample. The bit sequence usually contains one first bit which defines the polarity, i.e. the sign, of the amplitude of the signal, and a binary number which is used to define the absolute amplitude of the signal at the time sample. As a bit number can only define a finite number of values, the calculated average of the amplitude at the time sample is approximated towards the most proximate available value that can be defined by the binary number. It is said that the analogic signal has been quantified. Usually, amplitude steps separating two consecutive binary numbers are calculated by dividing the maximum amplitude of the analogic signal by the number of values that can be defined by the binary number, depending on the number of bits forming the binary number. A sequence of bits is then obtained for each time sample. All the bit sequences are joined consecutively, usually in the chronological order, to form the digital signal 14 shown in FIG. 1C.

FIG. 2 illustrates a sampled and quantified audible signal 16, wherein each sample has been attributed a bit sequence 18 as defined above to define the average amplitude of the signal at the time sample. In this example, the bit sequence comprises one polarity bit and a binary number composed of three bits to define the signal. According to the invention, each bit of the binary number has been associated to one or more transducers 20 able to emit an ultrasonic signal of a fundamental frequency greater than the sampling frequency of the sampled and quantified signal 16, and not audible by a human being. More specifically, the bit of rank 1 (the unit) has been associated to one transducer, the bit of rank 2 has been associated to two transducers, and the bit of rank 3 has been associated to four transducers. For each bit sequence, when a bit of rank n of the binary number has its value equal to "1", its associated transducers are activated during the attributed time sample. All the transducers playing at a given time sample are emitting acoustic signals of same amplitude in phase. For example, when the bit sequence contains a binary number equal to 101, the bit of rank 1 is "1", which means that its unique associated transducer is activated; the bit of rank 2 is "0", which means that its two associated transducers are off; and the bit of rank 3 is "1", which means that its four associated transducers are activated. A total of five transducers are thus activated during the time sample. Depending on the binary number attributed to a time sample, the number of activated transducers varies. Consequently, the sum of the amplitudes of the acoustic signals emitted by the transducers varies in time according to the variation of the binary numbers in the digital signal.

FIG. 3 illustrates the behavior of a transducer depending on the value of its associated bit in the binary number, for successive bit sequences. When decoding the digital signal, for the first bit sequence, the value of its associated bit is "0", which means that the transducer is off during the duration corresponding to the time sample of the bit sequence. For the second bit sequence, the value of its associated bit is "1", which means that the transducer is activated, i.e. on, and emits an acoustic signal 21, during the duration corresponding to the time sample of the bit sequence. Etc.

FIG. 4 illustrates an example of system adapted to operate the method described above. A computer 22 has as many outputs 22*a*, 22*b* as bits composing the binary number of each bit sequence of the digital signal, each output being particularly associated to one of those bits. For each bit sequence, when a bit has its value equal to "1", the computer uses its associated output to emit a low continuous electrical signal during the attributed time sample. Such signal is amplified by an amplifier 24*a*, 24*b*, and then modulated by a modulator 26*a*, 26*b* into a sinusoidal electrical signal of frequency corresponding to the frequency of operation of the transducers. Such sinusoidal signal is again amplified by an amplifier 28*a*, 28*b* to the desired amplitude of drive of each transducer 20*a*, 20*b*. When a bit has a value equal to "0", the computer does not emit any signal through its associated output, and the transducers 20*a*, 20*b* are consequently not driven by any electrical signal.

FIG. 5 illustrates the sum 29 of the amplitudes of the acoustic signals emitted by transducers thanks to the above described method, for a digital signal containing bit sequences with binary numbers increasing incrementally from 000 to 111, and then decreasing incrementally from 111 to 000. The resulting acoustic signal shows a carrier wave with the frequency of the transducers, and which is modulated in amplitude, in a quantified manner, by the number of activated transducers, according to the digital signal.

FIGS. 6 and 7 illustrate preferred arrangements of the transducers 20. The objective is to dispose all the transducers so that at a particular point in space, called focus, all the acoustic signals 21 coming from the transducers converge synchronously in phase. At the focus, the resulting acoustic signal is optimal for self-demodulation. In FIG. 6, the transducers are arranged facing inwards from the inner surface of a portion of a sphere 30. The focus is the center 32 of the sphere. In FIG. 7, the transducers 20 are arranged on a flat surface 34 which is perpendicular to the axis 36*a* of a parabola 36. The transducers 20 are also facing the parabola 36 parallel to the axis of the parabola 36. The focus point is then the focus 38 of the parabola.

In order to widely propagate the particular acoustic signal obtained at the focus, in FIG. 6, a slot 40 is arranged at the focus, which diffracts the acoustic signal such as obtained at the focus. In FIG. 7, a horn 42 is disposed with its inlet at the focus point, and spreads the acoustic signal.

FIGS. 8 to 11 are related to an experiment featuring the invention. The digital signal 44 of FIG. 8B is used as the source to be reproduced by the transducers. The digital signal 44 is composed of bit sequence 46 each comprising one polarity bit 48 and a bit number 50 of 2 bits. The digital signal is a sampling and quantification of an analogic signal 52, shown in FIG. 1A, comprising a single frequency sinusoidal wave. Only one wavelength is shown in FIG. 8, even though the signal is periodic and continuous. This digital signal is used as input in the method of the invention, such as it has been described in reference to the proceedings figures. However, it has not been used here any kind of focalization means or sound spread means along with the transducers. The transducers are only aligned parallel to each other.

FIG. 9 shows the measured effective received acoustic signal 54 at two meters from the transducers, in the time dimension. As explained above, it is observed a carrier wave of ultrasonic frequency, whose amplitude is modulated according to the transducers effectively activated across time, i.e. according to the exploitation made of the digital signal. The amplitude is given with an arbitrary unit. It can already be observed that the modulation of amplitude has a regular period of 0.5 milliseconds.

When transposing the measured signal of FIG. 9 into the frequency dimension, using a Fast Fourier Transformation, it is obtained the graphs 56, 58 of FIGS. 10 and 11. FIG. 10 shows the Fast Fourier Transformation of the signal between 36.5 and 41 kHz, and FIG. 11 shows the Fast Fourier Transformation of the signal between 0 and 20 kHz. As expected, a main amplitude peak 60 is observed at a frequency of 39 kHz, which is the operating frequency of the transducers. Thanks to the self demodulation phenomenon, a relatively important amplitude peak 62 is also observed at 2 kHz, which is the amplitude of modulation of the carrier signal. This peak represents an audible acoustic signal obtained from the ultrasonic signals of the transducers. Such acoustic signal obtained thanks to the invention is relatively faithful to the information originally contained in the digital signal.

The invention claimed is:

1. Method for reproducing an audible acoustic signal from a digital signal, the digital signal being formed of successive bit sequences each comprising bits representative of the amplitude of the audible acoustic signal at a time sample, the bits of each bit sequence including at least one quantification bit, the method comprising:

providing a plurality of transducers configured to emit acoustic signals that are wave trains having each a duration lower or equal to the duration of one time sample and comprising at least one oscillation per time sample, successively, for each bit sequence, having the or each quantification bit associated to at least one of the transducers and independently govern, depending on a value and a rank of the bit, at least two different amplitudes of the acoustic signals emitted by the transducer or each of the transducers associated to the quantification bit, in a manner so as to obtain a carrier wave of the audible acoustic signal that is modulated in at least two different amplitudes according to the digital signal.

2. Method according to claim 1, wherein the acoustic signal emitted by the transducers comprises at least several successive oscillations.

3. Method according to claim 1, wherein the acoustic signal emitted by the transducers is a periodic and alternating signal.

4. Method according to claim 1, wherein the acoustic signal emitted by the transducers is of sinusoidal shape.

5. Method according to claim 1, wherein a fundamental frequency of the acoustic signal emitted by the transducers is in the range of ultrasonic frequencies.

6. Method according to claim 1, wherein, in each bit sequence, the quantification bit or bits define a binary number which indicates a quantified absolute value of the amplitude of the acoustic signal to be reproduced at the time sample associated with the bit sequence.

7. Method according to claim 6, wherein, for each successive bit sequence, one of the value of each quantification bit does not induce any variation of the amplitudes of the acoustic signals emitted by its associated transducers, the other one of the value of each quantification bit induces a variation of the amplitudes of the acoustic signal or signals emitted by its associated transducer or transducers.

8. Method according to claim 7, wherein the transducers whose operations are not modified by any quantification bit are at an off default state.

9. Method according to claim 7, wherein, for each bit sequence, the bit or bits of a higher rank of the binary number induce either a greater variation in amplitude for each transducer, a variation in amplitude for more associated transducers, or both, than the bit or bits of lower rank of the binary number.

10. Method according to claim 7, wherein each transducer has the amplitude of its acoustic signal determined by at most one bit value of each bit sequence.

11. Method according to claim 1, wherein each transducer has only two different operating states, one of which is a default state.

12. Method according to claim 1, wherein each transducer has only three different operating states, one of which is a default state.

13. Method according to claim 1, wherein the digital signal is an electromagnetic signal, and wherein the transducers are electro-acoustic transducers driven by an alternative current or an alternative voltage.

14. Method according to claim 1, wherein the transducers are arranged so that the acoustic signals converge at a same focus in phase.

15. Method according to claim 1, wherein the transducers are all arranged facing outwards on a plane surface orthogonal to the axis of a parabolic surface, or are all arranged facing outwards on the internal surface of a sphere.

16. Method according to claim 1, wherein the amplitudes and the shapes of the acoustic signals emitted by the transducers are adapted to produce nonlinear demodulation of the acoustic signals into a lower frequency signal, as in an acoustic parametric array.

17. Method according to claim 1, wherein means of redirection of the signal are arranged at a focus.

18. A loudspeaker comprising a plurality of transducers configured to emit acoustic signals at a predetermined frequency which is equal or greater than any frequency of sampling of an audible acoustic signal, and arranged so that the acoustic signals converge at a same focus in phase, wherein the loudspeaker has a configuration in which a digital signal, being formed of successive bit sequences each comprising bits representative of the amplitude of the audible acoustic signal at a time sample, the bits of each bit sequence including at least one quantification bit, is used in a manner so that successively, for each bit sequence, the or each quantification bit is associated to at least one of the transducers and independently governs, depending on a value and a rank of the quantification bit, at least two different amplitudes of the acoustic signals emitted by the transducer or each of the transducers associated to the quantification bit, in a manner so as to obtain a carrier wave of the audible acoustic signal that is modulated in at least two different amplitudes according to the digital signal.

19. Method according to claim 2, wherein the acoustic signal emitted by the transducers is a periodic and alternating signal.

20. Method according to claim 8, wherein, for each bit sequence, the bit or bits of a higher rank of the binary number induce either a greater variation in amplitude for each transducer, a variation in amplitude for more associated transducers, or both, than the bit or bits of lower rank of the binary number.

* * * * *